United States Patent [19]

Cote

[11] 4,019,725

[45] Apr. 26, 1977

[54] GAS SEAL AND SILENCER FOR USE ON TUYERE BODY

[75] Inventor: Toussaint Cote, Noranda, Canada

[73] Assignee: Noranda Mines Limited, Toronto, Canada

[22] Filed: July 24, 1975

[21] Appl. No.: 598,806

[30] Foreign Application Priority Data

Apr. 21, 1975 Canada ..... 225085

[52] U.S. Cl. ..... 266/169; 266/218

[51] Int. Cl.[2] ..... F27D 3/16

[58] Field of Search ..... 266/41, 42, 269, 186, 266/218; 277/148–150, 154, 155, 157; 279/23

[56] References Cited

UNITED STATES PATENTS

| | | | |
|---|---|---|---|
| 123,173 | 1/1872 | Holland | 277/148 |
| 645,224 | 3/1900 | Boehling | 277/149 |
| 1,517,972 | 12/1924 | Faust | 266/41 |
| 1,689,874 | 10/1928 | Jabs | 277/148 |

OTHER PUBLICATIONS

Standard Handbook For Mechanical Engineers McGraw–Hill, 1958, pp. 6–25 to 6–29, Baumeister et al.

*Primary Examiner*—Gerald A. Dost
*Attorney, Agent, or Firm*—Fleit & Jacobson

[57] ABSTRACT

A gas seal and silencer is provided for attachment to a tuyere body to minimize the gas volume and pressure loss during the insertion of a punch bar through a tuyere valve closing the tuyere and so reduce the noise created by the blast of gas leaking out during opening of the tuyere valve. The gas seal and silencer comprises a housing adapted to be secured to the tuyere body with its longitudinal axis substantially in alignment with the longitudinal axis of the tuyere, and closure means mounted within the housing for forming a seal about the punch bar when inserted in the housing. Such closure means may consist of a plurality of closure members mounted for movement toward and away from the punch bar and include means for forcing the closure members against the periphery of the punch bar so as to form a seal between the closure members and the punch bar when the punch bar is inserted in the housing. Such closure members may consist of a plurality of jaws mounted within such housing for radial movement toward and away from the longitudinal axis of the housing and having the ends thereof adapted to contact the punch bar shaped so as to substantially match the periphery of the punch bar. Means are provided for guiding such jaws in their radial movement toward and away from the longitudinal axis of the housing. The ends of the jaws adapted to contact the punch bar are rounded so as to permit the entrance of the punch bar through the jaws even if the punch bar is slightly out of alignment with respect to the longitudinal axis of the housing during insertion of the punch bar through the housing.

9 Claims, 2 Drawing Figures

GAS SEAL AND SILENCER FOR USE ON TUYERE BODY

Figure 1:
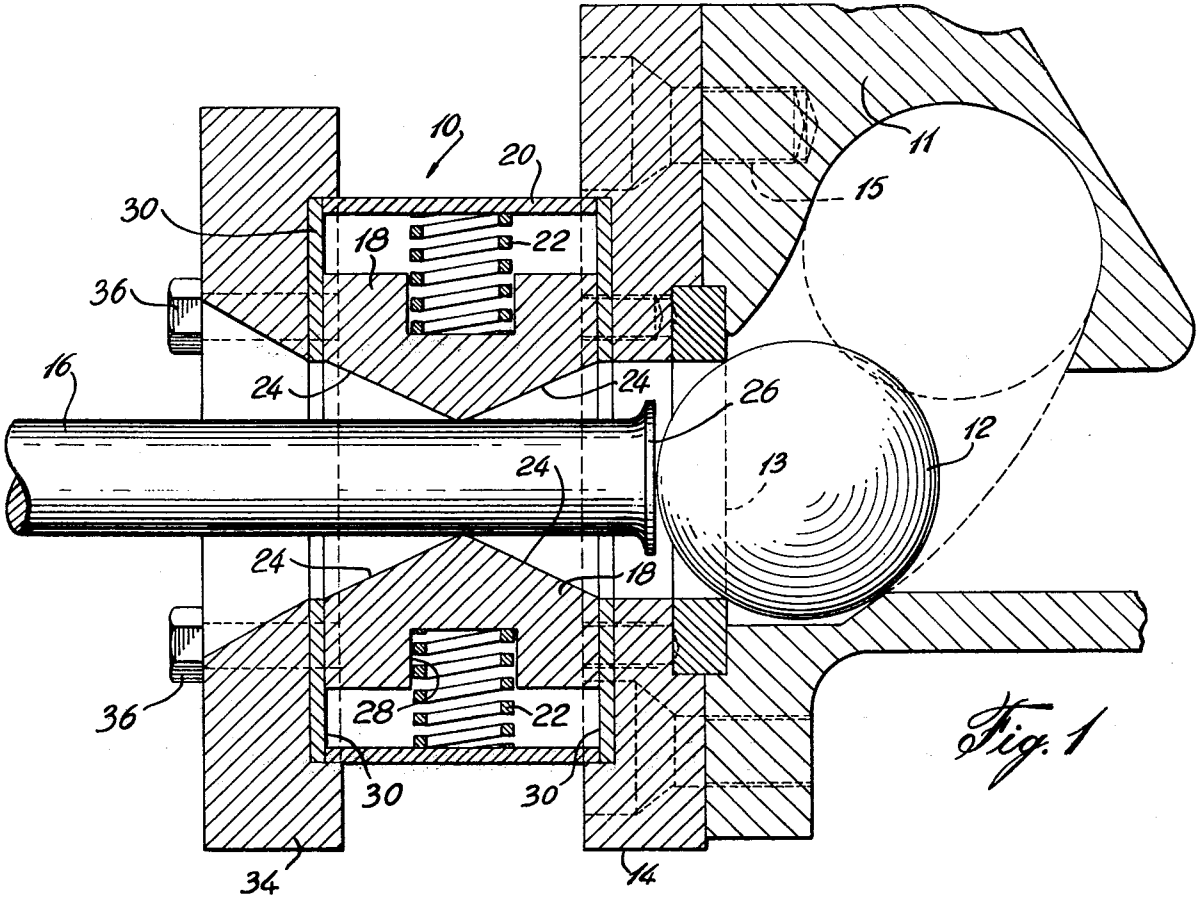

This invention relates to a gas seal and silencer for use on metallurgical vessel tuyere bodies.

In smelting of certain metals, it is common practice to remove some of the impurities by treatment of the molten metal in a metallurgical vessel by blowing gas into the bath, with one or several submerged tuyeres. The accretions forming at the end of the tuyere have to be removed to maintain the gas flow. For many years, this was done manually by inserting a punch bar into the tuyere. The bar lifts the ball-type seal or flapper valve, common in the industry, and goes fully into the tuyere to remove the accretion and is subsequently pulled out. This operation is referred to as punching the tuyere. It is the objective of the ball or flapper valve to allow the tuyere to be penetrated during operation. while the bar is held inside the tuyere, gas escapes between the bar and the seat of the ball or flapper causing a loss of gas volume and pressure and creating a loud gas blast noise and possibly ejecting particles of hot metal.

Several mechanical punching machines have been designed. Some are attached to each tuyere and they provide a solution to noise and hot metal particles, but cause restriction of full gas flow. Other mechanical punching machines such as the one described in Canadian Pat. No. 727,540 issued Feb. 8, 1966 are mounted on rails away from the metallurgical vessel and retract the punch bars completely away from the tuyere thus providing full gas flow in the tuyere and positive removal of the accretions.

With the present design of the ball-type seal or flapper valve, the penetration of the seal by the punch bar, whether hand operated or by a machine such as the puncher disclosed in the above Canadian Patent, still causes loss of blowing gas volume and pressure, with corresponding noise of escaping gas and can produce flying metal particles. Several methods and apparatus to improve the tuyere seal and reduce the noise level have been proposed by mounting the seal device on the punching bar or machine itself but none of these have been found practical or effective, and they are costly to install and service.

It is therefore the object of the present invention to provide a simple, rugged gas seal and silencer to minimize the gas volume and pressure loss and accompanying noise during punching and to prevent flying metal particles ejected from the tuyere seal or valve.

The gas seal and silencer, in accordance with the invention, comprises a housing adapted to be secured to the tuyere body, with its longitudinal axis substantially in alignment with the longitudinal axis of the tuyere, and closure means mounted within the housing for forming a seal about the punch bar when the punch bar is inserted in the housing.

Such closure means may consist of closure members mounted within the housing for movement toward and away from the punch bar, and include means for forcing the closure members against the periphery of the punch bar so as to form a seal between the closure members and the punch bar when the punch bar is inserted in the housing.

In a preferred embodiment of the invention, the closure means may take the form of a plurality of jaws mounted within such housing for radial movement toward and away from the longitudinal axis of the housing and having the ends thereof adapted to contact the punch bar shaped so as to substantially match the periphery of the punch bar. Means are provided for guiding such jaws in their radial movement toward and away from the longitudinal axis of the housing. The ends of the jaws adapted to contact the punch bar are rounded so as to permit the entrance of the punch bar through the jaws even if the punch bar is slightly out of alignment with respect to the longitudinal axis of the housing during insertion of the punch bar into the housing.

The jaws are preferably tapered from the outside toward the ends thereof contacting the punch bar. The punch bar may be provided with a head having a section greater or smaller than the section of the punch bar. In the case wherein the section of the head of the punch bar is greater than the section of the punch bar itself, the jaws are tapered in both directions so as to facilitate entry and exit of the punch bar into and out of the housing.

The means for guiding the jaws may consist of the end walls closing the housing and contacting the sides of the jaws, such end wall having a central opening for passing the punch bar. In a preferred embodiment of the invention, each end wall consists of a wear plate closing the housing and of a backing end plate, and means are provided for securing such end plates together. Each end plate may be provided with a cavity deep enough to receive the wear plate and an end portion of the housing. The housing, wear plates, jaws and springs are made of metal and the contacting surfaces of the wear plates and jaws and the ends of the jaws contacting the punch bar are preferably hardened so as to reduce wear of the sliding surfaces.

The means forcing the closure members or jaws against the punch bar may consist of one or a plurality of springs, each spring having one end contacting the inside wall of the housing and its other contacting a closure member or jaw.

In the preferred embodiment of the invention, each jaw has a recess drilled into the end oppsoite to the one facing the punch bar and a helical spring is inserted into such recess.

Figure 2:
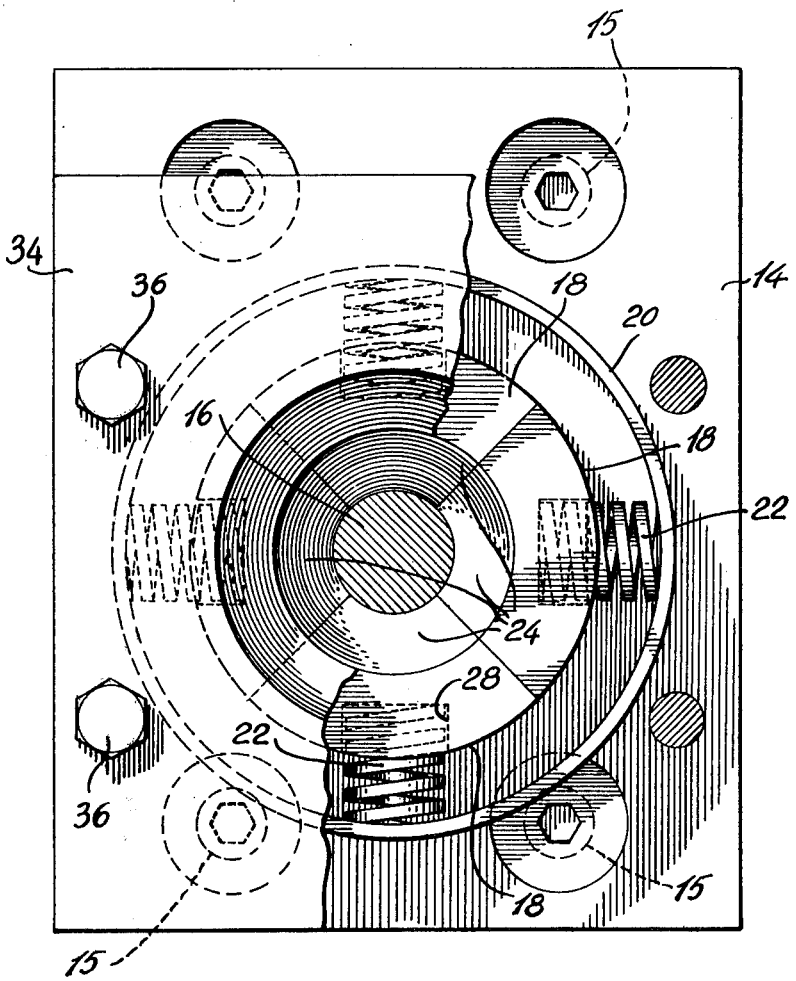

The invention will now be disclosed, by way of example, with reference to a preferred embodiment thereof illustrated in the accompanying drawings in which:

FIG. 1 illustrates a central section view through the gas seal and silencer with a punch bar inseted into the tuyere; and FIG. 2 illustrates an elevation view of the gas seal and silencer with a portion of the front plate removed th shhow the housing and jaws.

Referring t FIG. 1, there is shown a gas seal and silencer 10 attached to a tuyere body 11. The tuyere is normally closed by a ball valve 12 which is seated on a ring 13 held against the tuyere body by a face plate 14 which is secured to the tuyere body by bolts 15. The ball valve is open during punching by a punch bar 16 which is inserted into the tuyere for removing accretions at the end of the tuyere located inside the bath of the metallurgical vessel.

The gas seal and silencer 10 comprises four closure members in the form of jaws 18 located inside a housing 20 and pressed toward the longitudinal axis of the housing by springs 22. The jaws 18 are tapered from the outside toward the ends contacting the punch bar as indicated at 24 so that, when the punch bar is inserted into the seal, the jaws are forced to slide open by the action of the bar on the tapered ends of the jaws. It will be easily seen that such taper will permit the entrance of the punch bar into the housing even if the punch bar is slightly out of alignment with the longitudinal axis of the housing. The punch bar 16 is provided with a head 26 having a cross-section which is larger than the cross-section of the punch bar for efficient removal of the accretions in the tuyeres and, for this reason, the jaws are provided with two tapered ends 24 so as to permit raising of the jaws both during entry and exit of the punch bar into and out of the gas seal and silencer. The ends 24 of the jaws contacting the punch bar are shaped so as to correspond to a segment of a circle in cross-section in order to match the periphery of the punch bar 16. In cases where the punch bar is not circular, it will be understood that the ends of the jaws will preferably be made to match the section of the punch bar. The ends of the jaws opposite to those contacting the punch bar have recesses 28 therein and the springs 22 are lodged in such recesses to be held in position.

The jaws are guided by wear plates 30 which close the housing 20 except for a central opening to permit passing of the punch bar. The sides of the jaws and wear plates 30 are hardened so as to reduce wear of the sliding surfaces. The ends of the jaws contacting the punch bar 16 are also hardened for the same purpose.

For attaching the gas seal and silencer 10 to the tuyere body, a recess is made in the face plate 14 and the ends of the housing 20 and wear plates 30 are inserted in such recess and a similar recess made in a heavy plate 34. Plate 34 is secured to face plate 14 by bolts 36.

The above disclosed gas seal and silencer operates as follows: when the head 26 or the end of the punch bar 16 is inserted into the housing 20, the jaws 18 are forced to slide open by the action of the punch bar on the taper walls 24 of the jaws. When the head of the punch bar 16 has penetrated in the housing 20, the jaws close around the punch bar 16 which, on continued insertion, pushes the ball seal 12 open with none or very little gas escaping into the atmosphere past the seal formed by the jaws squeezing around the punch bar 16 under the action of springs 22. Since little or no gas escapes, noise is minimized and there is no possibility of ejection of hot metal chips. Because there is no pressure loss, accretion removal is more effective. When the accretions have all been removed by the punch bar, the punch bar is pulled out. The ball valve 14 drops against seat 13 sealing the tuyere, and the head of the punch bar spreads out the jaws, allowing the bar 16 to be removed.

The above gas seal and silencer may be adapted to different types of tuyere bodies, and/or machine punchers. The silencer is suitable for the puncher described in the above mentioned Canadian Patent although its use is not confined to such puncher only.

The gas seal and silencer as described in the present specification has been tested on an operating Pierce Smith copper converter. Measured sound levels are given in the following Table 1:

TABLE 1

| Sound Levels - Pierce Smith Converter (Distance 6-ft) | |
|---|---|
| Punching with air seal and silencer: | 95 dba |

TABLE 1-continued

| Sound Levels - Pierce Smith Converter (Distance 6-ft) | |
|---|---|
| Punching without air seal and silencer: | 116 dba |

The background noise level was 94 dba. It is to be noted that the lowest noise level of the invention is not known from this test because of the high level of the background noise due to other operations.

The above disclosed air seal and silencer was also tested on an operating continuous smelting and converting reactor as described in U.S. Pat. No. 3,437,475 issued Apr. 8, 1969. Measured sound levels are given in the following Table 11:

TABLE 11

| Sound Levels - Continuous Smelting and Converting Reactor (Distance 6 ft) | |
|---|---|
| Punching with air seal and silencer: | 95 dba |
| Punching without air seal and silencer: | 118 dba |

The background noise level was 95 dba. It is to be noted that the lowest noise level of the invention is not known from this test because of the high level of the background noise due to other operations.

It is to be understood that various modifications may be made to the embodiment illustrated in FIGS. 1 and 2 within the spirit of the invention. For example, various means other than wear plates 30 may be provided for guiding the jaws. Such guiding means could even be integral with the housing 20. The housing 20 could be closed by the end plates 14 and 34 themselves and one of the end plates 14 or 34 could possibly be integral with housing 20. The number of jaws may also ary and be as low as 2 and higher than 4. Also, various means other than springs 22 may be used for forcing the jaws 18 around the punch bar, such as air pressure derived from the tuyere itself or from an independent source. It will also be understood that housing 20 is not necessarily cylindrical but coul also be of square, rectangular or polygonal cross-section. Furthermore, plural rows of jaws may be provided if required and corresponding partitions or wear plates designed for guiding the jaws in each row. Finally, the end of the jaws contacting the punch bar need not be tapered and could simply be rounded out to permit entrance of the punch bar in cases werein there is slight misalignment between the punch bar and the longitudinal axis of the housing during insertion of the punch bar into the housing.

Although the invention has been disclosed with reference to a preferred embodiment, it is to be understood that alternative embodiments are envisaged within the scope of the claims and the spirit of the invention. For example, the closure members may take various forms. Any closure means capable of forming a seal about the punch bar when the punch bar is inserted in the housing may be used.

What is claimed is:

1. A gas seal and silencer for attachment to a tuyere body to minimize the gas volume and pressure loss during the insertion of a punch bar through a the blast of gas leaking out during opening of the tuyere valve, comprising:

a. a housing adapted to be secured to the tuyere body with its longitudinal axis substantially in alignment with the longitudinal axis of the tuyere and having end walls provided with a central opening for passing a punch bar through the longitudinal axis of the housing;

b. a plurality of closure members mounted for movement toward and away from the longitudinal axis of the housing and including means located inside the housing for pressing said closure members toward the longitudinal axis of the housing before insertion of the punch bar through the longitudinal axis of the housing and for forcing said closure members against the periphery of the punch bar after insertion of the punch bar so as to form a seal between the closure members and the punch bar; and c. means for guiding said closure members in their movement toward and away from the longitudinal axis of the housing, said means for guiding the closure members consisting of wear plates located on each side of the closure members, said wear plates and the sides of the closure members being both made of hardened metals so as to reduce wear of the sliding surfaces.

2. A gas seal and silencer as defined inn claim 1, wherein said closure members consist of a plurality of jaws mounted within said housing for radial movement toward and away from the longitudinal axis of said housing, the ends of the jaws adapted to contact the punch bar being shaped so as to substantially match the periphery of the punch bar and rounded so as to permit the entrance of the punch bar through the jaws even if the punch bar is slightly out of alignment with respect to the longitudinal axis of the housing during insertion of the punch bar through the housing.

3. A gas seal and silencer as defined in claim 2, wherein said jaws are tapered so as to permit the entrance of the punch bar through the jaws.

4. A gas seal and silencer as defined in claim 3, wherein the punch bar is provided with a head having a section greater than the section of the punch bar, and wherein the jaws are tapered in both directions so as to facilitate entry and exit of the punch bar into and out of the housing.

5. A gas seal and silencer as defined in claim 1, wherein each end wall consists of one of said wear plates and of a backing end plate, and further comprising means for securing said end plates together.

6. A gas seal and silencer as defined in claim 5, wherein each end end plate is provided with a recess facing said housing, said recess being deep enough to receive said wear plate and an end portion of the housing.

7. A gas seal and silencer as defined in claim 1, wherein said means for pressing the closure members toward the longitudinal axis of the housing and for forcing the closure members against the punch bar after insertion of the punch bar consist of individual springs, each having one end contacting an inside wall of the housing and the other end contacting a closure member.

8. A gas seal and silencer as defined in claim 1, wherein said means for pressing the closure members toward the longitudinal axis of the housing and for forcing the jaws against the punch bar after insertion of the punch bar consist of individual helical springs and wherein each jaw has a recess drilled into the end opposite to the one facing the punch bar for inserting one end of the spring into such recess, the other end of each helical spring contacting the inside wall of the housing.

9. A gas seal and silencer for attachment to a tuyere body for minimizing the gas volume and pressure loss during the insertion and removal of a punch bar through a valve closing the tuyere, and for reducing the noise created by the blast of gas leaking out during opening and closing of the tuyere valve, the gas seal and silencer comprising:

a. a housing adapted to be secured to the tuyere body with its longitudinal axis substantially in alignment with the longitudinal axis of the tuyere and having end walls provided with a central opening for receiving and expelling a punch bar in the direction of the longitudinal axis of the housing;

b. a plurality of closure members mounted for movement toward and away from the longitudinal axis of the housing from a spacing substantially equal to the external dimension of the punch bar to a spacing in excess of the external dimension of the punch bar;

c. means located inside the housing for pressing said closure members toward the longitudinal axis of the housing before insertion and after removal of the punch bar through said housing, for forcing said closure members into said spacing substantially equal to the external dimension of the punch bar in the absence of the punch bar, and for forcing said closure members against the periphery of the punch bar after insertion of the punch bar so as to form a seal between the closure members and the punch bar; and d. guide means for guiding said closure members in their movement toward and away from the longitudinal axis of the housing from said spacing substantially equal to the external dimension of the punch bar to said spacing in excess of the external dimension of the punch bar bar; said guide means consisting of wear plates located on each side of the closure members, said wear plates and the sides of the closure members being both made of hardened metals so as to reduce wear of the sliding surfaces.

* * * * *

UNITED STATES PATENT OFFICE

CERTIFICATE OF CORRECTION

PATENT NO. : 4,019,725

DATED : April 26, 1977

INVENTOR(S) : Cote

It is certified that error appears in the above-identified patent and that said Letters Patent are hereby corrected as shown below:

Column 2, line 49 change "inseted" to --inserted--;

line 52 change "th" to --to--;

line 53 change "shhow" to --show--;

line 54 change "t" to --to--.

Column 4, line 42 change "coul" to --could--.

Claim 1, line 3, after "through a" insert --valve closing the tuyere, and to reduce the noise created by--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*